US011478890B2

(12) United States Patent
Hessler et al.

(10) Patent No.: US 11,478,890 B2
(45) Date of Patent: Oct. 25, 2022

(54) ASSEMBLY FOR SHARPENING AND OBSERVING WEAR ON A BLADE

(71) Applicant: EdgeCraft Corporation, Avondale, PA (US)

(72) Inventors: William Hessler, Avondale, PA (US); George Jensen, Avondale, PA (US); Lee Clark, Avondale, PA (US); Rick Stapleford, Avondale, PA (US); Zach Siskind, Avondale, PA (US); Bela Elek, Avondale, PA (US)

(73) Assignee: EDGECRAFT CORPORATION, Avondale, PA (US)

( * ) Notice: Subject to any disclaimer, the term of this patent is extended or adjusted under 35 U.S.C. 154(b) by 816 days.

(21) Appl. No.: 16/423,740

(22) Filed: May 28, 2019

(65) Prior Publication Data

US 2019/0358763 A1 Nov. 28, 2019

Related U.S. Application Data

(60) Provisional application No. 62/676,624, filed on May 25, 2018.

(51) Int. Cl.
*B24B 3/54* (2006.01)
*B24B 49/12* (2006.01)

(52) U.S. Cl.
CPC ..... *B24B 3/54* (2013.01); *B24B 49/12* (2013.01)

(58) Field of Classification Search
CPC .... B24B 3/52; B24B 3/54; B24B 3/36; B24B 3/60; B24B 3/605; B24D 15/063; B24D 15/065; B24D 15/08; B24D 15/085
See application file for complete search history.

(56) References Cited

U.S. PATENT DOCUMENTS

| | | | | |
|---|---|---|---|---|
| 5,793,493 | A * | 8/1998 | Lane | G01B 11/24 356/613 |
| 6,113,476 | A | 9/2000 | Friel, Sr. et al. | |
| 6,881,137 | B2 | 4/2005 | Friel, Sr. | |
| 7,494,403 | B2 | 2/2009 | Friel, Sr. | |
| 8,915,766 | B1 * | 12/2014 | Kolchin | B24B 49/12 451/5 |
| 9,308,613 | B2 | 4/2016 | Eriksson | |
| 9,902,035 | B2 | 2/2018 | Layton, Jr. et al. | |
| 10,272,535 | B1 * | 4/2019 | Lyons | B24B 49/04 |
| 2004/0266318 | A1 * | 12/2004 | Doman | B24B 47/22 451/5 |
| 2007/0197148 | A1 * | 8/2007 | Friel | B24B 3/54 451/349 |
| 2012/0156964 | A1 * | 6/2012 | Anderson | B24B 3/54 451/259 |

(Continued)

*Primary Examiner* — Joel D Crandall

(74) *Attorney, Agent, or Firm* — Michael E. Dockins; Shumaker, Loop & Kendrick, LLP

(57) ABSTRACT

A knife sharpener comprises a grinding surface for grinding a blade of the knife when the blade is moved relative to the grinding surface and an observation device including a sensor element and a display element. The sensor element is configured to observe the blade and to collect data regarding the blade when the blade is moved relative to the sensor element. The display element is configured to communicate a condition of the blade to an operator of the observation device. The condition of the blade is based on the data collected by the sensor element when the blade is moved relative to the sensor element.

17 Claims, 9 Drawing Sheets

(56) References Cited

U.S. PATENT DOCUMENTS

| | | | | |
|---|---|---|---|---|
| 2017/0232569 | A1* | 8/2017 | Dovel | B24B 21/002 451/45 |
| 2018/0028898 | A1 | 2/2018 | Chan et al. | |
| 2018/0236623 | A1* | 8/2018 | Robinson | B24B 53/003 |
| 2019/0210177 | A1* | 7/2019 | Graves | B24B 55/02 |

* cited by examiner

ASSEMBLY FOR SHARPENING AND OBSERVING WEAR ON A BLADE

FIELD OF THE INVENTION

This patent application claims priority to U.S. Provisional Patent Application Ser. No. 62/676,624, filed on May 25, 2018, the entire disclosure of which is hereby incorporated herein by reference.

FIELD OF THE INVENTION

The invention relates to a device for observing and analyzing the blade of a knife, and also to an assembly including a knife sharpening device and the device for observing and analyzing the blade of the knife, wherein the device for observing and analyzing is utilized prior to or following each sharpening process carried out using the knife sharpening device.

BACKGROUND OF THE INVENTION

It is desirable to sharpen the blades of knifes following wear to the knife surfaces. The edge of the blade may become dull or may incur various surface defects, each of which reduces the effectiveness of the blade. The surface defects may include nicks, jagged surfaces, and localized burrs formed in the edge of the blade following repeated use thereof.

The sharpening of the blade may include grinding a beveled surface immediately adjacent the edge at a preselected angle to form a bevel in one side of the knife blade. Depending on the type of knife, the sharpening process may be repeated on the other side of the blade to form a double bevel. In some circumstances, the sharpening process may further include forming a secondary or tertiary beveled surface to introduce a compound bevel into the blade, wherein the compound bevel includes each of the beveled surfaces disposed at a different angle of inclination. The removal of the blade material from the edge during the formation of each beveled surface also eliminates any indented or projecting surface features forming the aforementioned nicks and localized burrs. The blade is left with a pointed edge having an operator selected angle of inclination for each beveled surface.

Such sharpening processes typically include the need to perform multiple different sharpening steps to achieve the desired edge on the blade. For example, a first step may include the use of a coarse grinding tool for establishing an initial bevel at a desired angle, a second step may include the use of a finer grinding tool for refining the bevel of the first step, and a third step may include a finishing or polishing tool for finalizing the edge of the blade. If a double bevel is used, each step must be performed with respect to each side of the blade as well. If a compound bevel is used, each step may be associated with forming another of the bevels of the blade edge.

Electric knife sharpeners have been developed that utilize guide surfaces and corresponding rotating grinding surfaces to ensure that consistent bevels are formed in the blade at desired angles of inclination. Such electric sharpeners may include multiple different sets of the guide surfaces and corresponding grinding surfaces for achieving each of the aforementioned steps with respect to each side of the blade. During many sharpening processes, the operator of the electric sharpener may desire to form a consistent burr along an entirety of the edge of the blade with the burr facing away from the grinding surface before proceeding to the next step of the sharpening process. The burr indicates that enough material has been removed from the side of the blade edge being ground such that the material begins to flow and curl over to the other side of the edge.

Many operators of such electric sharpeners struggle with determining when to proceed to the next stage of the sharpening process with respect to each side of the blade. In some circumstances, the blade is only in need of refinement and may not require the use of an initial grinding step, hence the procession through each step may be unnecessary. In other circumstances, the operator may find difficulty in determining when a suitable and consistent burr has been formed along the edge following a sharpening process. The detection of a suitable burr along the edge also typically requires the operator to run his or her fingers over the blade edge in a direction perpendicular to the direction of extension of the edge in order to determine if the material has curled over to the side of the edge opposite the grinding surface. Many operators struggle with making such a determination or are generally uncomfortable directly handling the edge of the blade, hence the operator may proceed to the next step prematurely or following excessive grinding of the blade. The detection of the burr also does not ensure that the angle of the bevel is as desired following each step of the sharpening process, hence the resulting bevel may not have the desired configuration.

It would therefore be desirable to produce a device suitable for observing, measuring, and analyzing various conditions of the blade in order to determine if additional forming of the blade is necessary or desired. It would further be desirable to incorporate such a device into a corresponding sharpening device to allow for immediate observation of the blade prior to or following the conclusion of each sharpening step carried out using the sharpening device.

SUMMARY OF THE INVENTION

Compatible and attuned with the present invention, an assembly including a knife sharpening device and a blade observation device has surprisingly been discovered.

According to one embodiment of the invention, an observation device for observing a blade of a knife is disclosed. The observation device comprises a sensor element configured to observe the blade and to collect data regarding the blade when the blade is moved relative to the sensor element and a display element configured to communicate a condition of the blade to an operator of the observation device. The condition of the blade is based on the data collected by the sensor element when the blade is moved relative to the sensor element.

According to another embodiment of the invention, a knife sharpener comprises a grinding surface for grinding a blade of the knife when the blade is moved relative to the grinding surface and an observation device including a sensor element and a display element. The sensor element is configured to observe the blade and to collect data regarding the blade when the blade is moved relative to the sensor element. The display element is configured to communicate a condition of the blade to an operator of the observation device. The condition of the blade is based on the data collected by the sensor element when the blade is moved relative to the sensor element.

According to another embodiment of the invention, a method of determining a condition of a blade of a knife prior to or following a sharpening process is disclosed. The method comprises the steps of providing an observation device including a sensor element and a display element; moving the blade relative to the sensor element to observe the blade and collect data regarding the blade; and communicating a condition of the blade to an operator of the observation device following the moving of the blade relative to the sensor element.

BRIEF DESCRIPTION OF THE DRAWINGS

The above, as well as other objects and advantages of the invention, will become readily apparent to those skilled in the art from reading the following detailed description of a preferred embodiment of the invention when considered in the light of the accompanying drawings.

DETAILED DESCRIPTION OF THE INVENTION

The following detailed description and appended drawings describe and illustrate various embodiments of the invention. The description and drawings serve to enable one skilled in the art to make and use the invention, and are not intended to limit the scope of the invention in any manner. In respect of the methods disclosed, the steps presented are exemplary in nature, and thus, the order of the steps is not necessary or critical.

The present invention relates to an observation device 20 for observing a blade of a knife. Depending on the application, the observation device 20 may be further configured to collect data related to the observations taken by the device 20, to store and analyze the collected data, and to make determinations regarding one or more conditions of the blade based on the analysis of the data. The observation device 20 may be provided independently of an associated sharpener as a stand-alone unit (FIGS. 4-6) or may be integrated into the structure of an associated sharpening device (FIGS. 10-17) such as an electric knife sharpener, as one non-limiting example. The observation device 20 may be integrated into the structure of the sharpening device (FIGS. 10 and 12-17) or may be provided as an accessory for removable coupling to the sharpening device (FIG. 11).

Figure 1:
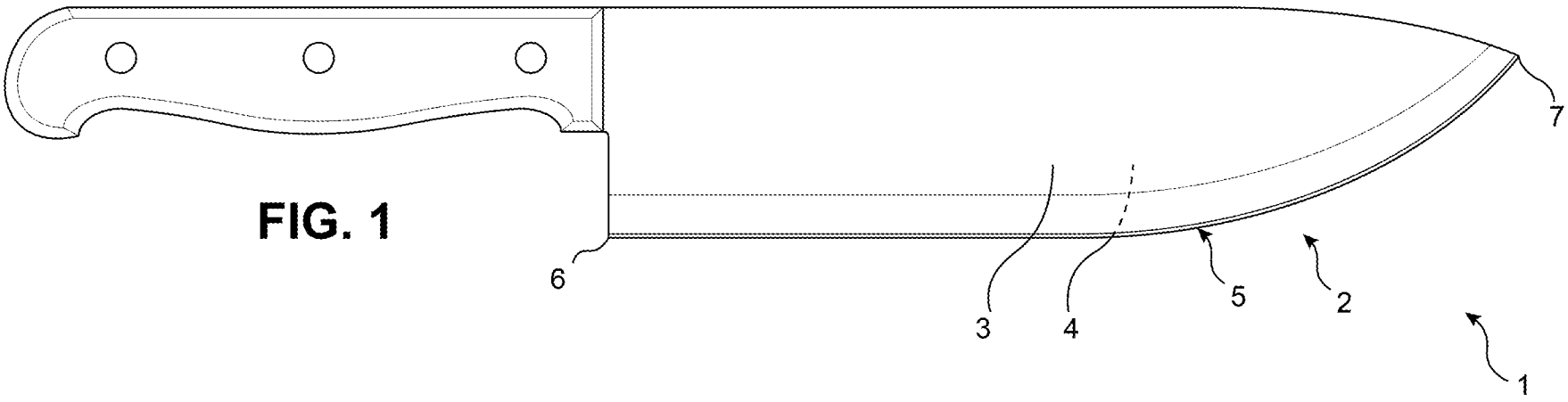
FIG. 1 is an elevational side view showing an exemplary knife.

FIG. 1 illustrates an exemplary knife 1 for establishing the terms used hereinafter when describing the operation of the observation device 20. The knife 1 includes a blade 2 having a first face 3, an oppositely arranged second face 4, and a cutting edge 5 formed at one intersection of the first face 3 and the second face 4. The edge 5 extends longitudinally from a heel 6 of the blade 2 to a tip 7 of the blade 2.

Figure 2B:
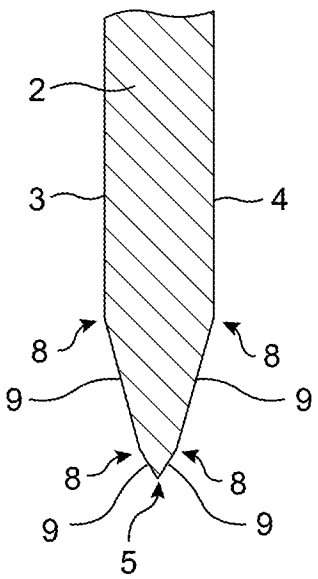
FIG. 2B is an elevational cross-sectional view showing a blade having a compound double bevel.
Figure 2A:
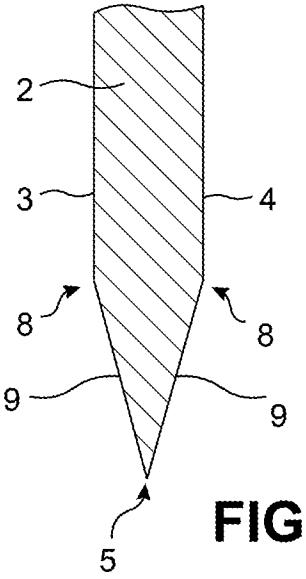
FIG. 2A is an elevational cross-sectional view showing a blade having a double bevel.

The blade 2 includes at least one bevel 8 for forming the pointedness of the edge 5. The introduction of each of the bevels 8 forms a corresponding facet 9 of the blade 2 extending towards the edge 5 thereof. Each of the facets 9 is arranged to be inclined relative to the adjacent face 3, 4 of the blade 2 to cause an inward tapering of the blade 2 towards the edge 5. FIG. 2A illustrates a cross-section of the blade 2 while having a single bevel formed symmetrically to each side of a centrally located edge 5 while FIG. 2B illustrates a cross-section of a blade 2 while having a compound or double bevel formed symmetrically to each side of the centrally located edge 5. However, it will be appreciated by one skilled in the art that the teachings of the present invention may be adapted for use with a blade 2 having any variety of bevel configurations, including a single bevel, non-symmetric bevels, and multiple bevels of varying angles of inclination, as desired.

The sharpening device associated with the observation device 20 may be a manual knife sharpener or an electric knife sharpener, as desired. A suitable manual knife sharpener is disclosed in U.S. Pat. No. 6,881,137 to Friel, Sr., the disclosure of which is hereby incorporated herein in its entirety. Alternative manual knife sharpeners may be used without necessarily departing from the scope of the present invention.

The observation device 20 is shown throughout as being associated with electric knife sharpeners having a rotating grinding surface used to form a bevel relative to one face 3, 4 of the blade 2 with respect to each pass of the blade 2 through the respective electric knife sharpener. The electric knife sharpeners may each be substantially similar to the electric knife sharpener disclosed in U.S. Pat. No. 6,113,476 to Friel, Sr., the disclosure of which is hereby incorporated herein in its entirety. However, one skilled in the art will readily appreciate that the teachings of the present invention may be adapted for use with any type of electric or automatic sharpening device without departing from the scope of the present invention, including the use of substantially any form of grinding tool or grinding surface for forming the blade 2 of the knife 1 prior to or following each stage of the sharpening process. The electric knife sharpeners are described in greater detail hereinafter when describing the assemblies including a combination of both the observation device 20 and the corresponding electric knife sharpener.

Figure 3:
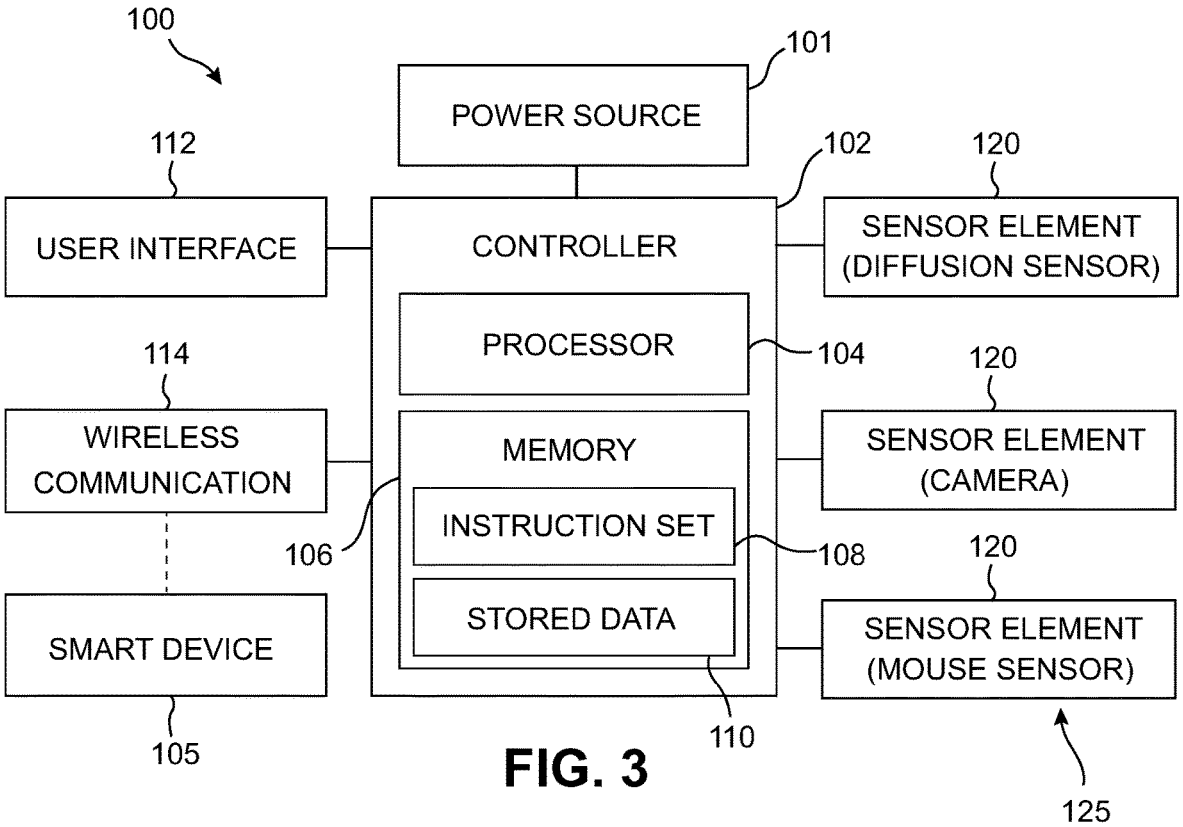
FIG. 3 is a schematic representation of a control system of an observation device according to an embodiment of the present invention.

FIG. 3 illustrates a control system 100 suitable for operating the observation device 20. A power source 101 generally powers the control system 100 and each component thereof. The power source 101 may be a portable power source such as a battery or a non-portal power source such as an electrical outlet, as desired. The observation device 20 may accordingly include any necessary structure for housing one or more batteries or any necessary structure (such as a plug) for accessing the electrical outlet, as desired.

The control system 100 includes a controller 102 having a processor 104 and a memory 106. The memory 106 may be used to store any instruction sets 108 for processing by the processor 104 as well as any data 110 collected during the process of observing the blade 2. The instructions sets 108 may be related to the observation and analysis of the blade 2 as well as the interactions between the observation device 20 and an operator thereof, such as controlling the interactions between the operator and a corresponding user interface 112. The memory 106 may be flash memory, as one non-limiting example. The stored data 110 may be raw data regarding the direct observations of any sensors associated with operation of the observation device 20 or the stored data 110 may be associated with the analysis of the raw data and the determinations made by the control system 100 in response to the analysis of the data.

The memory 106 may be further configured to store historical data regarding previous uses of the observation device 20. For example, in some embodiments, the memory 106 may be configured to store information regarding a time stamp of the use of the observation device 20, the number of passes used to achieve a desired edge 5, the selected angle of inclination of an associated bevel 8, or any such information regarding any particular sharpening process or knife having been sharpened. For example, such information may be stored to allow the operator to determine when a particular knife was last sharpened and what settings were used in order to achieve the resulting edge 5.

Figure 4:
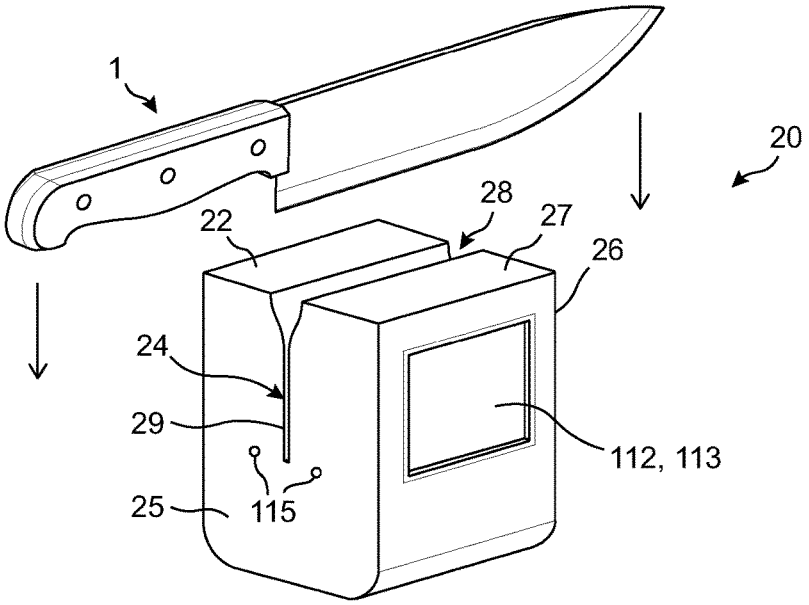
FIG. 4 is a perspective view illustrating a stand-alone version of the observation device having a dedicated housing and a knife prior to insertion into a slot of the observation device.

The controller 102 is shown in FIG. 3 as being in signal communication with each of the user interface 112 and a wireless communication module 114. The user interface 112 may include a display screen 113 used to show the observations or data collected by the observation device 20. One exemplary display screen 113 is shown in FIG. 4. The user interface 112 may be configured to provide messages or prompts to an operator of the observation device 20 or may be configured to present images relating to the observations of any observation device 20, such as an image taken of the blade 2 when observed at a particular position, as non-limiting examples. The user interface 112 may include independently provided input units or buttons or a touch-screen interface to allow the operator to interact with the results displayed on the display screen 113.

In addition to the display screen 113, the user interface 112 may further include a plurality of progress indicators 115 (shown throughout FIGS. 10-15 and 17) disposed adjacent each sensor assembly associated with carrying out the observations of the observation device 20. Each progress indicator 115 may be a light source such as a light emitting diode (LED) that lights up or changes color in reaction to a determination made by the observation device 20 following a sharpening process. For example, following a first sharpening pass with respect to a grinding surface the corresponding progress indicator 115 may display a red light indicating that the facet 9 of the blade 2 being ground is not yet ready to proceed to the next sharpening stage. As the blade 2 progresses towards the desired condition, the progress indicator 115 may eventually transition to a yellow light to indicate the sharpening trend is improving. Once fully sharpened in accordance with the desired shape and configuration of the edge 5, the progress indicator 115 may then display a green light indicating that the blade 2 is ready to progress to another sharpening stage, which may include sharpening an opposing facet 9 of the blade 2 or progressing to another coarser/finer/polishing grinding surface, as non-limiting examples. In some embodiments, the progress indicators 115 may instead be presented as speakers or other sound emitters that give auditory cues to the operator regarding the progress of the blade 2 following each sharpening pass or stage. The information disclosed as being presented via the progress indicators 115 may also be displayed directly to the display screen 113, as desired.

The wireless communication module 114 is optional and includes the necessary hardware and programming to allow the controller 102 to communicate with external devices using any known wireless communication protocol, such as wi-fi or Bluetooth®, as non-limiting examples. The inclusion of the wireless communication module 114 in the control system 100 may remove the need for a dedicated user interface 112 directly associated with the observation device 20. Instead, the observation device 20 may be in wireless signal communication with a smart device 105 such as a phone or tablet having corresponding wireless communication capabilities as well as a dedicated display screen and user interface suitable for controlling the observation device 20. The smart device 105 may be able to download an application having software for displaying the data collected by the observation device 20 and for handling any of the interactions between the operator and the observation device 20. The smart device 105 may also be beneficially utilized to handle the analysis of some or all of the data collected by the controller 102. The distribution of some or all of the processing of the more complicated processes of the observation device 20 to the smart device 105 may allow for the observation device 20 to be produced with a reduced capacity processor, thereby lowering the cost and complexity of the observation device 20. The smart device 105 also presumably includes a built-in user interface, which may further remove the need to incorporate any type of user interface or display screen directly into the observation device 20. The smart device 105 may also be able to store the data otherwise stored to the memory 106 of the controller 102 to increase the storage capacity of the observation device 20.

The display screen 113 associated with the user interface 112 or the display screen (not shown) of the associated smart device 105 may be utilized to magnify the observations of the observation device 20 to the operator thereof. The display screen 113 or smart device 105 may display the observations, such as an image generated when using an optical sensor in signal communication with the controller 102, at any desired magnification based on the resolution of the associated sensor, such as 10× to 400× magnification.

As used herein, references to any data collected or analyzed by the observation device 20 being displayed to the operator of the device 20 may accordingly refer to the data being displayed visually via the display screen 113 or the smart device 105, via a change in condition of one of the progress indicators 115, or via an auditory signal provided by a speaker or the like incorporated into the observation device 20. Accordingly, references to a display element as used hereinafter generally refer to any electronic device in signal communication with the control system 100 of the observation device 20 in a manner suitable for communicating a condition of the blade 2 to the operator of the observation device 20. The condition of the blade 2 communicated to the operator may refer to any raw data collected by the observation device 20 or to any determinations made by the observation device 20 regarding the condition of the blade 2 following analysis of the collected raw data. Accordingly, the display element communicating a condition of the blade to the operator broadly refers to the use of a device for observing the blade in conjunction with a device for communicating information to the operator in any of the ways discussed herein.

The controller 102 is also in signal communication with a plurality of sensor elements 120 used to perform the observations of the observation device 20. The control system 100 is illustrated in FIG. 3 as being in signal communication with three of the sensor elements 120, but it will be appreciated by one skilled in the art that the observation device 20 may include any number of the sensor elements 120 depending on the features included in the corresponding observation device 20. Additionally, the observation device 20 may be integrated into the structure of a corresponding electric knife sharpener having multiple different grinding surfaces, and one or more of the sensor elements 120 may be dedicated to observing the blade 2 immediately after having passed by each of the grinding surfaces. For example, an electric knife sharpener having three different stages for sharpening two opposing faces 3, 4 of the blade 2 may require a minimum of six of the sensor elements 120 to have at least one of the sensor elements 120 dedicated to each of the grinding surfaces.

The sensor elements 120 may be arranged into a plurality of spaced apart sensor assemblies 125, wherein each of the sensor assemblies 125 is associated with observing a condition of the blade 2 with respect to a different face 3, 4 of the blade 2 or a different pass of the blade 2 through the corresponding sharpening device. For example, the aforementioned electric knife sharpener having three different stages for grinding two opposing faces 3, 4 of the blade 2 may include six of the sensor assemblies 125, wherein each of the six sensor assemblies 125 includes at least two or more of the sensor elements 120 for observing the blade 2 from at least two different perspectives or using at least two distinct observational methods.

The control system 100 is illustrated in FIG. 3 as having a single sensor assembly 125 including three different types of sensor elements 120. As used herein, each sensor element 120 accordingly refers to a device configured to make a specific observation, such as an observation relating to a specific wavelength of the electromagnetic waves being observed, while each sensor assembly 125 refers to an arrangement of one or more of the sensor elements 120 positioned for observing the blade 2 at a specific location or orientation.

The sensor elements 120 may each be provided as an emitter and receiver pair, wherein the emitter emits electromagnetic waves at a desired wavelength and at a desired orientation while the receiver receives and collects data regarding electromagnetic waves received at a detected wavelength and at a detected orientation. In some circumstances, one or more of the sensor elements 120 may include only a receiver for receiving electromagnetic waves, such as an optical camera used in the absence of an accompanying visible light source associated with the optical camera. In many circumstances, the emitter and the receiver may be incorporated into a single structure. In other circumstances, the emitter and the receiver may be spaced apart based on the desired angles at which the electromagnetic waves are desired to be emitted or received. The emitter may include an array of spaced apart emitters and the receiver may include an array of spaced apart receivers, wherein the use of the arrays aid in ensuring that an entirety of the portion of the blade 2 in need for observation is properly observed. For example, the emitters or receivers may be arranged at different orientations or have different shapes for viewing the observed portion of the blade 2 from more than one perspective, thereby ensuring that certain features are not obscured as could be possible when viewed from a single perspective based on the different angles present between the various faces 3,4 and facets 9 of the blade 2.

Each of the sensor assemblies 125 of the observation device 20 may include any variety of the aforementioned sensor elements 120 arranged at any variety of different orientations suitable for viewing a specific portion of the blade 2 as it passes thereby during use of the observation device 20. The sensor elements 120 may be oriented to primarily observe the portions of the blade extending from the edge 5 to a point beyond the most distant bevel 8 formed in the face 3, 4 instantaneously being observed. One or more of the sensing elements 120 may include a lens or sensing surface arranged substantially parallel to the face 3, 4 of the blade 2 facing towards the sensing elements 120. Alternatively, one or more of the sensing elements 120 may include a lens or sensing surface arranged substantially parallel to one of the facets 9 of the blade 2 formed adjacent the edge 5, as desired. In other circumstances, the one or more of the sensing elements 120 may be arranged at an angle between the plane of the corresponding face 3, 4 and the plane of the corresponding facet 9.

In any circumstance, the substantially perpendicular viewing arrangement of the aforementioned parallel arranged surfaces is useful for achieving a profile view of the blade 2 (or substantial equivalent thereof). Such a profile view may be useful in determining the jaggedness of any of the provided bevels 8 or the edge 5 as introduced by surface defects such as nicks, localized burrs, or barbs. Another one or more of the sensor elements 120 may be oriented substantially perpendicular to one or more of the aforementioned sensor elements 120 to view the blade 2 in a direction substantially parallel to the associated face 3, 4 of the blade 2 or to one of the facets 9 of the blade 2 facing towards the observation device 20. Such a view may be useful in detecting the presence of a burr extending away from the edge 5 in a direction towards the associated sensor element 120.

One or more of the sensor elements 120 associated with each of the sensor assemblies 125 may be configured to detect the initial presence of the blade 2 relative to a corresponding one of the sensor assemblies 125 via the initial observation of the characteristics of a blade 2 via the corresponding one of the sensor elements 120. For example, the presence of the blade 2 may interrupt the emittance or reception of electromagnetic waves normally associated with the absence of the blade 2, thereby indicating that an observing process is about to occur or that a dual sharpening and observing process is about to occur (when the corresponding sensor assembly 125 is assigned to a specific grinding surface). One or more of the sensor elements 120 may also be configured to act as a motion detector via the changing conditions sensed by the sensor elements 120 during the movement of the blade 2 relative to the corresponding sensor assembly 125, as explained in greater detail hereinafter in reference to the different types of sensor elements 120 for use with the observation device 20. The sensor elements 120 may be configured to continuously take observations during motion of the blade 2 based on a prescribed observation iteration rate (frame rate or the like) of the sensor element 120 or based on iterations of a distance the blade 2 has moved as determined by the sensor elements 120. The controller 102 may be configured to reference prior iterations of observing the blade 2 in order to calibrate future iterations of observing the blade 2 to normalize the results of each future iteration.

The observation device 20 may alternatively include a dedicated motion sensor or the like for determining when a pass has been made by the blade 2 past the corresponding sensor assembly 125. The ability of the observation device 20 to detect each pass of the blade 2 allows for the observation device 20 to act in its simplest form as a blade pass detector and counter. The observation device 20 may be configured to display or otherwise communicate the number of passes that have occurred with respect to a particular grinding surface to continuously inform of the operator of the progress of the sharpening process.

The three different types of sensor elements 120 disclosed in FIG. 3 include a diffusion sensor, an imaging camera, and a mouse sensor. The observation device 20 may also be utilized with a sensor element 120 provided as a 3-dimensional scanning sensor, but such a sensor is not described in detail hereafter. The general features of the different types of sensor elements 120 are described hereinafter in turn.

The diffusion sensor utilizes diffusion mapping to observe the blade 2 when passed thereby. Diffusion mapping compares the theoretical diffusion pattern that would be produced by the reflectance of electromagnetic energy from a known and carefully-controlled source off of a perfect surface of exactly the correct angle (such as the desired angles of the bevels 8 as disclosed herein) in comparison to the actual diffusion pattern produced by the same source reflecting electromagnetic energy off of a real surface (the edge 5 of the blade 2 being observed). The extent and displacement of the deviations of the real surface from the theoretical surface are then correlated to the actual surface roughness and angle of each face 3, 4 or facet 9 of the blade 2. If oriented properly, the diffusion sensor may also be utilized to detect the presence of a burr along the edge 5, the existence of jaggedness along the edge 5, or the existence of bluntness along the edge 5, as desired. The diffusion sensor generally utilizes an emitter and a receiver for establishing the orientations necessary for measuring the reflections of the electromagnetic energy in the manner desired. The diffusion sensor may include an array of emitters and receivers, as desired. The diffusion sensor may utilize infrared light as the electromagnetic energy source, as one non-limiting example.

The imaging camera or optical camera is configured to acquire high-resolution images of the blade 2 based on the reflection of visible light off the blade 2. The camera is provided with a light source that may utilize a relatively narrow wavelength in order to minimize the introduction of external interference during use of the observation device 2. As mentioned previously, the resolution and focused field of view of the camera may allow for magnification of the images taken by the camera. The images taken by the camera may be configured for analysis by the controller 102 or the associated smart device 105 in communication with the controller 102. The images may be analyzed for determining conditions of the blade 2 such as the surface finish thereof, the presence of defects in the edge 5 such as nicks, and the presence of burrs along the edge 5.

The mouse sensor refers to any of a variety of navigation sensors utilizing an emitter for focusing electromagnetic energy onto a surface using either a diffraction lens or a field of view lens. The emitter may be a vertical cavity surface emitting laser (VCSEL), an LED, or an infrared LED, as desired. A receiver of the mouse sensor may be an active pixel sensor configured to collect the radiant energy being applied to the corresponding surface and convert the corresponding signal into a quantity that varies as a function of the surface roughness of the surface being observed. The mouse sensor is accordingly configured for measuring the surface roughness of one or more faces 3, 4 or facets 9 of the blade 2 during observation thereof. The mouse sensor may also be utilized to detect the motion of the blade 2 including the speed and amount of distance moved in similar fashion to the traditional operation of a mouse sensor. The mouse sensor may include a digital signal processor that detects patterns in the data received by the receiver of the mouse sensor and then determines how those patterns have moved upon detection of relative movement between the mouse sensor and the surface being observed.

The observation device 20 may be configured to include information regarding the desired characteristics of a variety of different sharpening processes and edge configurations to allow for observation device 20 to properly determine when a stage or step has been completed. For example, the observation device 20 should be configured to detect the difference between a variety of different bevel inclinations in order to accommodate different knives and different edge configurations applied to any one of the knives. The observation device 20 may be configured for preselected bevel/grind angle(s) such as 14, 15, 16, 18, or 20°, as non-limiting examples.

The general operation of the observation device 20 is first described with reference to the use of a stand-alone version of the observation device 20 as disclosed in FIGS. 4-8. The stand-alone version is not coupled to or integrated into the structure of a corresponding electric or manual knife sharpener, but is instead configured for use prior to or following a pass of the knife 1 through an independently provided electric or manual knife sharpener. In this way, the observation device 20 may be used to first determine what type of forming or finishing process should be applied to the edge 5 of the blade 2 prior to an initial pass of the knife 1 through the corresponding knife sharpener. The observation device 20 is also able to be used following each pass of the knife 1 through the corresponding sharpener to determine if the current step or stage of the sharpening process has been sufficiently completed. The stand-alone observation device 20 is accordingly configured for use with essentially any type of sharpening device or mechanism when used to periodically observe and analyze the blade 2 of the knife 1 before or after the sharpening process carried out on the blade 2.

Figure 6:
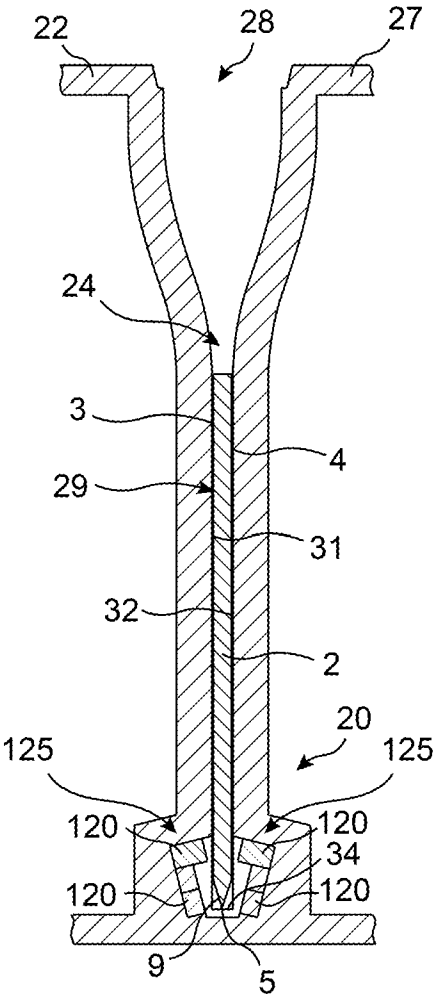
FIG. 6 is an elevational fragmentary cross-sectional view showing the relevant components of the observation device as viewed from the perspective of section line 6 in FIG. 5.
Figure 5:
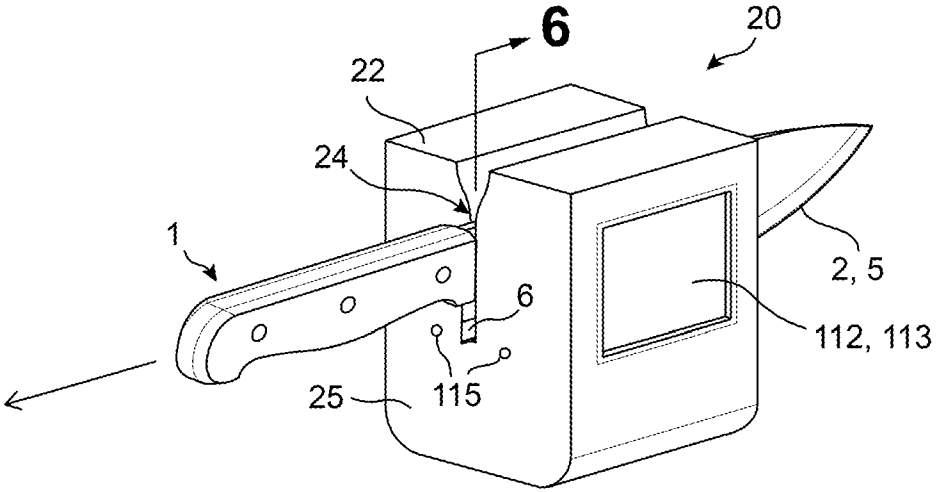
FIG. 5 is a perspective view illustrating the stand-alone version of the observation device when the knife is received within the slot formed in the housing of the observation device.

FIGS. 4 and 5 illustrate one exemplary housing 22 suitable for housing the observation device 20. The housing 22 defines a slot 24 extending from a front face 25 to a rear face 26 of the housing 22 and projecting downwardly from an upper face 27 of the housing 22. The slot 24 includes an enlarged mouth 28 that tapers inwardly to a constant width portion 29 having a width substantially similar to, but slightly greater than, a width of a blade 21 suitable for use with the disclosed housing 22 and observation device 20. As best shown in FIG. 6, a first inner surface 31 and a second inner surface 32 defining opposing sides of the constant width portion 29 of the slot 24 form face guide surfaces for either of the faces 3, 4 of the knife 5 to engage when the blade 2 is pulled longitudinally through the slot 24. The housing 22 may further include an edge guide surface 34 against which at least a portion of the edge 5 may rest when pulled through the slot 24.

Referring again to FIG. 6, the first inner surface 31 includes a first one of the sensor assemblies 125 disposed therein while the second inner surface 32 includes an oppositely and symmetrically arranged second one of the sensor assemblies 125 disposed therein. The use of two opposing sensor assemblies 125 beneficially allows for both faces 3, 4 of the blade to be observed during a single pull of the blade 2 through the slot 24. The sensor assemblies 125 may be inset into the face guide surfaces to allow for the faces 3, 4 of the blade 2 to pass thereby without interfering with any of the associated sensor elements 20 while remaining close enough to properly observe the blade 2. The sensor assemblies 125 may be further inset to a position extending below the edge guide surface 34 along a removed or indented portion of the edge guide surface 34 to allow one or more of the sensor elements 120 associated with each of the sensor assemblies 125 to have sensing access to approach the edge 5 of the blade 2 from below without the interference of the edge guide surface 34. As shown by comparison of FIGS. 5 and 6, the sensor assemblies 125 are positioned adjacent the front face 25 of the housing 22 to allow the entirety of the cutting surface formed by the edge 5 to pass by the sensor assemblies 125 when the knife 1 is pulled through the slot 24.

Figure 7:
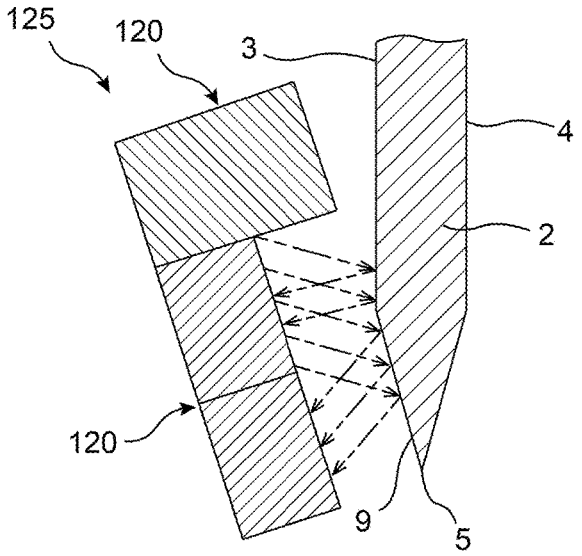
FIG. 7 is an elevational cross-sectional view showing a portion of a blade and a sensor assembly in isolation during operation of one sensor element of the sensor assembly.
Figure 8:
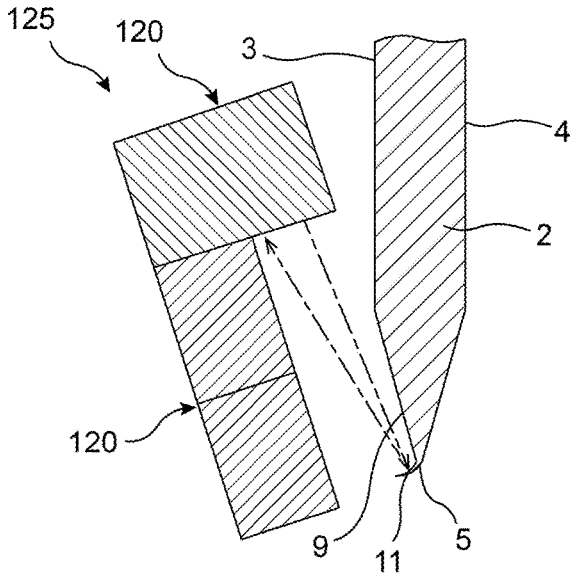
FIG. 8 is an elevational cross-sectional view showing the portion of a blade and the sensor assembly in operation during operation of another sensor element of the sensor assembly.

FIGS. 7 and 8 illustrate an enlarged fragmentary view of one of the sensor assemblies 125 shown in FIG. 6 to better illustrate the operation thereof. The illustrated sensor assembly 125 configuration is suitable for detecting a variety of different conditions regarding the blade 2 during a single pass of the blade 2 thereby. The sensor assembly 125 includes a first one of the sensor elements 120 arranged substantially parallel to the adjacent and facing facet 9 of the blade 2 adjacent the edge 5 and a second one of the sensor elements 120 arranged perpendicular to the first one of the sensor elements 120.

As explained above, the first one of the sensor elements 120 arranged parallel to the facet 9 (or the adjacent face 3, 4 in some embodiments) may be best suited for detecting such conditions of the blade 2 including the surface finish or roughness thereof, the angle formed between any two adjacent faces 3,4 and/or facets 9, the presence of defects formed in the edge such as nicks and barbs, and in some circumstances the presence of a longitudinally extending and consistent burr extending along the edge 5 and projecting laterally towards the sensor assembly 125. FIG. 7 illustrates the parallel arranged first one of the sensor elements 120 in operation and shows how the electromagnetic energy emitted by the emitter of the sensor element 120 reacts differently when encountering the different angles of inclination present between the first face 3 and the facet 9 to in turn cause a different pattern of the electromagnetic energy when detected by the receiver of the sensor element 120.

The perpendicular arranged second one of the sensor elements 120 may be primarily devoted to detecting the presence of one of the burrs 11 along the edge 5 based on the orientation of the second one of the sensor elements 120. FIG. 8 illustrates an example of how electromagnetic energy emitted from the second one of the sensor elements 120 may be received by the second one of the sensor elements 120 in order to detect the lateral extension of the burr 11 away from the edge 5. The burr detection as performed by the second one of the sensor elements 120 may be representative of any of the sensor types disclosed herein, as desired, but may be limited by the resolution of the associated sensor type.

The arrangement of the sensor assembly 125 as disclosed in FIGS. 7 and 8 is not limited to the use of only two of the sensor elements 120. For example, two or more of the sensor elements 120 may be arranged parallel to the facet 9 of the blade 2 while one of the sensor elements 120 is arranged perpendicular thereto. The additional sensor elements 120 may be disposed in line with the remaining sensor elements 120 with respect to the direction of travel of the edge 5 when moving past the sensor assembly 125. The sensor assembly 125 may include one or more of each of the diffusion sensor, the optical camera, and the mouse sensor, as desired.

The observation device 120 generally operates as follows. First, the blade 2 of the knife 1 is positioned within the slot 24 with the heel 6 of the blade 2 positioned adjacent the longitudinal position of each of the sensor assemblies 125 within the slot 24. The knife 1 is then pulled in a direction towards the front face 25 of the housing 22 to cause the entirety of the cutting surface formed by the edge 5 to pass by the opposing sensor assemblies 125 from the heel 6 to the tip 7 thereof. The operator of the observation device 20 may have to reorient the blade 2 during the pulling of the knife 1 to maintain contact of the edge 5 with the corresponding edge guide surface 34 if the blade 2 includes a curved or multi-angled edge 5, as needed. Each of the sensor assemblies 125 observes and records the data regarding the corresponding face 3, 4 of the blade 2 as the edge 5 of the blade 2 continuously passes by the viewing range of each of the sensor assemblies 125. The controller 102 associated with the sensor assemblies 125 receives the data and performs the necessary functions for analyzing the data and making any necessary determinations regarding the condition of the blade 2. The condition of the blade 2 is then communicated to the operator of the observation device 2 via the user interface 112 or the associated smart device 105. The operator may then determine whether to proceed to the next stage or whether additional sharpening is required based on the communicated determinations made by the observation device 20. The observation device 20 may also store any data regarding the sharpening session that may be referenced during a future session.

Figure 9:
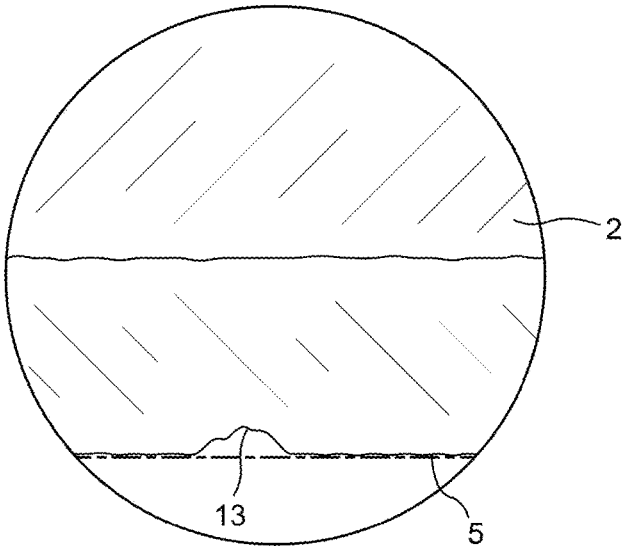
FIG. 9 is a representative enlarged side profile view of an edge of the blade showing the deviations in the contour of the edge relative to a reference line.

FIG. 9 illustrates a profile view of the edge 5 of the blade 2 illustrating one series of analyses that may be performed using the observation device 20. The dashed line in FIG. 9 may be representative of a reference line that may be established by the plane of the edge guide surface 34. As can be seen in FIG. 9, the edge 5 may include surface features such as a nick 13 that deviates substantially from the reference line. One of the parallel arranged sensor elements 120 as disclosed in FIG. 7 may be utilized to observe the profile of the edge 5 as the edge 5 passes thereby during a pass of the blade 2 through the slot 24. The associated sensor element 120 may take periodic measurements of the deviation of the edge 5 from the reference line to determine a jaggedness of the edge 5 relative to the reference line. The controller 102 of the observation device 20 may be configured to analyze and map the resulting data regarding the deviations of the edge 5 from the reference line to determine characteristics of the edge 5. For example, the collected data may be analyzed to determine a knife blade root mean squared (RMS) value or roughness average (Ra) of the edge 5, wherein the quantities of the RMS value and the Ra value are related to the amount of variance and hence jaggedness of the edge 5. The RMS value and the Ra value may be calculated with respect to each pass of the blade 2 through the slot 24 in order to determine if a change in the values has occurred that is indicative of the sharpening process working as intended. The observation device 20 may be configured to indicate that the blade 2 has reached the necessary progress when the trend or relative change in the RMS or RA values indicates the complication of the associated stage or step. Similar progressive comparisons or trends may be considered when determining other conditions of the blade 2 following multiple passes of the blade 2, as desired. In other circumstances, the progression to another step may only be achieved when a desired result has been achieved, such as the observing and communicating of the desired angle formed by any given bevel formed in the blade 2 by the sharpening process.

Although shown and described with reference to the single bevel in FIGS. 7 and 8, one skilled in the art should appreciate that the methods described herein may be adapted for use with a blade 2 having any number of bevels 8 and facets 9 without departing from the scope of the present invention.

Figure 10:
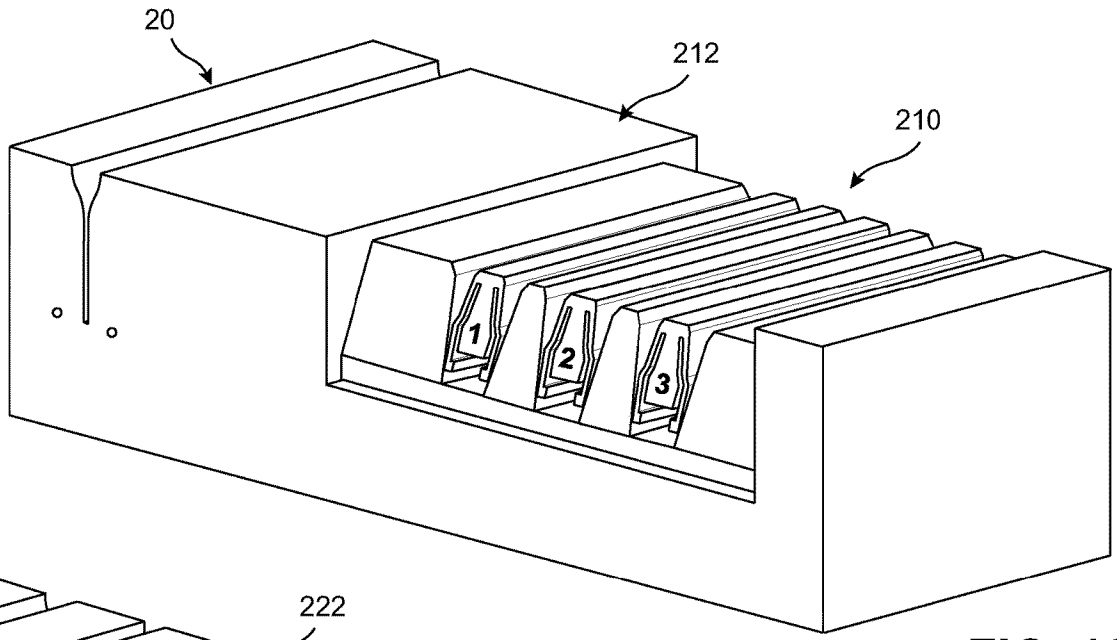
FIG. 10 is a perspective view of an electric knife sharpener having an observation device integrated into a common housing having a grinding surface for sharpening a blade.
Figure 11:
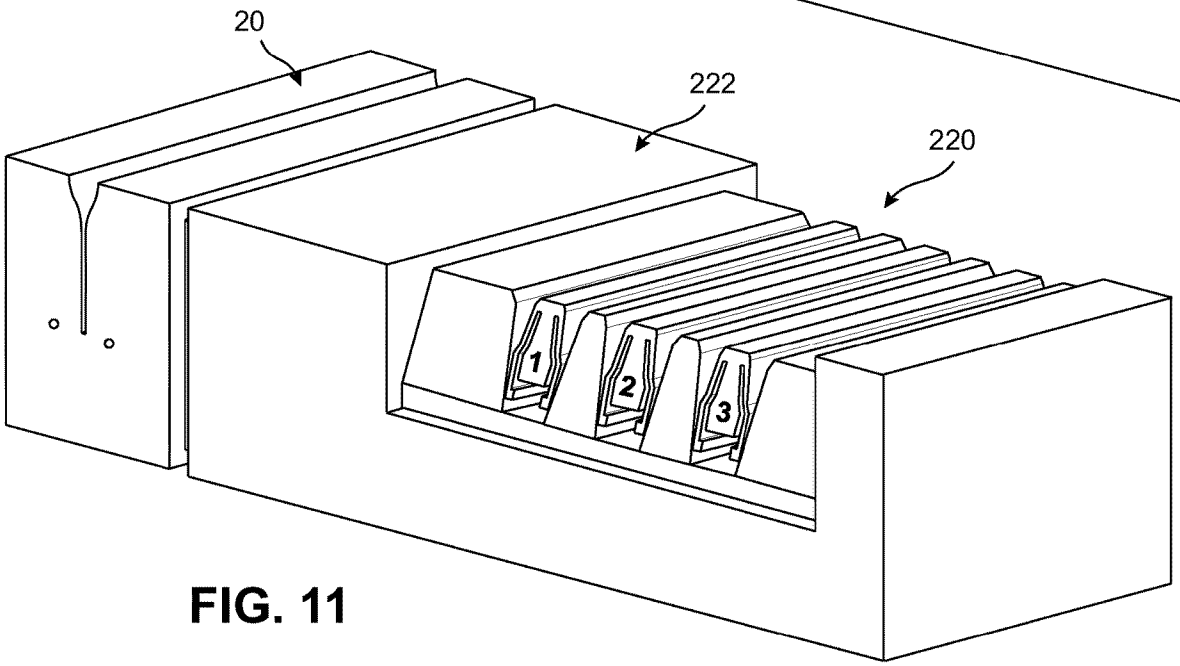
FIG. 11 is a perspective view of an electric knife sharpener having the observation device coupled thereto as a removable accessory.

FIG. 10 illustrates the observation device 20 and a corresponding electric knife sharpener 210 as being integrated into a common housing 212. The observation device 20 includes substantially identical structure to that disclosed in FIGS. 4-8, hence further description is omitted. The use of the common housing 212 allows for the observation device 20 to be quickly accessed following each pass of the knife 1 by one of the grinding surfaces of the electric knife sharpener 210. The observation device 20 and the remainder of the electric knife sharpener 210 may share a common power source, as desired.

FIG. 11 illustrates the observation device 20 as an add-on accessory configured for removable coupling to a housing 222 of an electric knife sharpener 220. The observation device 20 may accordingly be coupled to the electric knife sharpener 220 in place of another corresponding accessory or coupling when the use of the observation device 20 is desired. The observation device 20 may also be provided to be able to share electrical power or information with the electrical knife sharpener 220 when coupled thereto, as desired. The removable observation device 20 may further be configured to be operational when removed from the electric knife sharpener 220 to essentially take on the characteristics of the stand-alone version described above.

Figure 12:
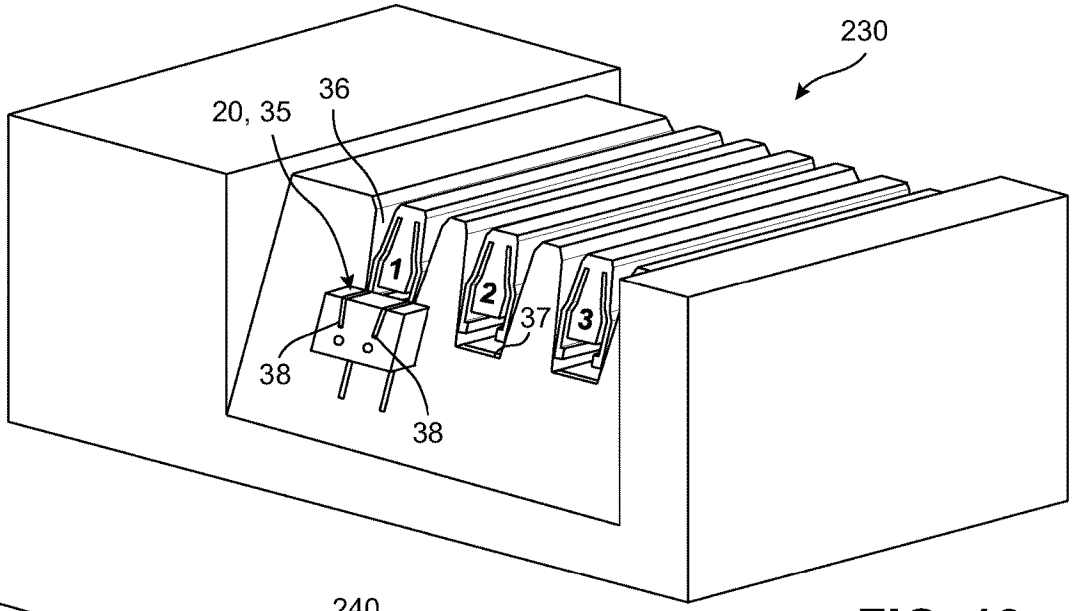
FIG. 12 is a perspective view of an electric knife sharpener having the observation device installed into a moveable housing retractable relative to a first sharpening stage of the electric sharpener.
Figure 13:
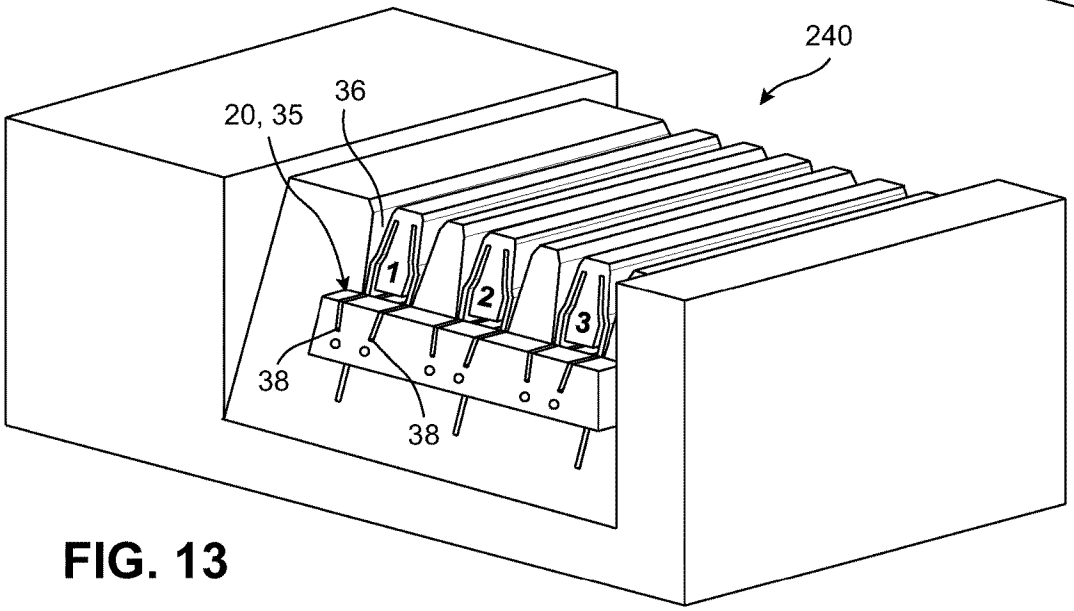
FIG. 13 is a perspective view of an electric knife sharpener having the observation device installed into a moveable housing retractable relative to all three of the sharpening stages of the electric sharpener.
Figure 14:
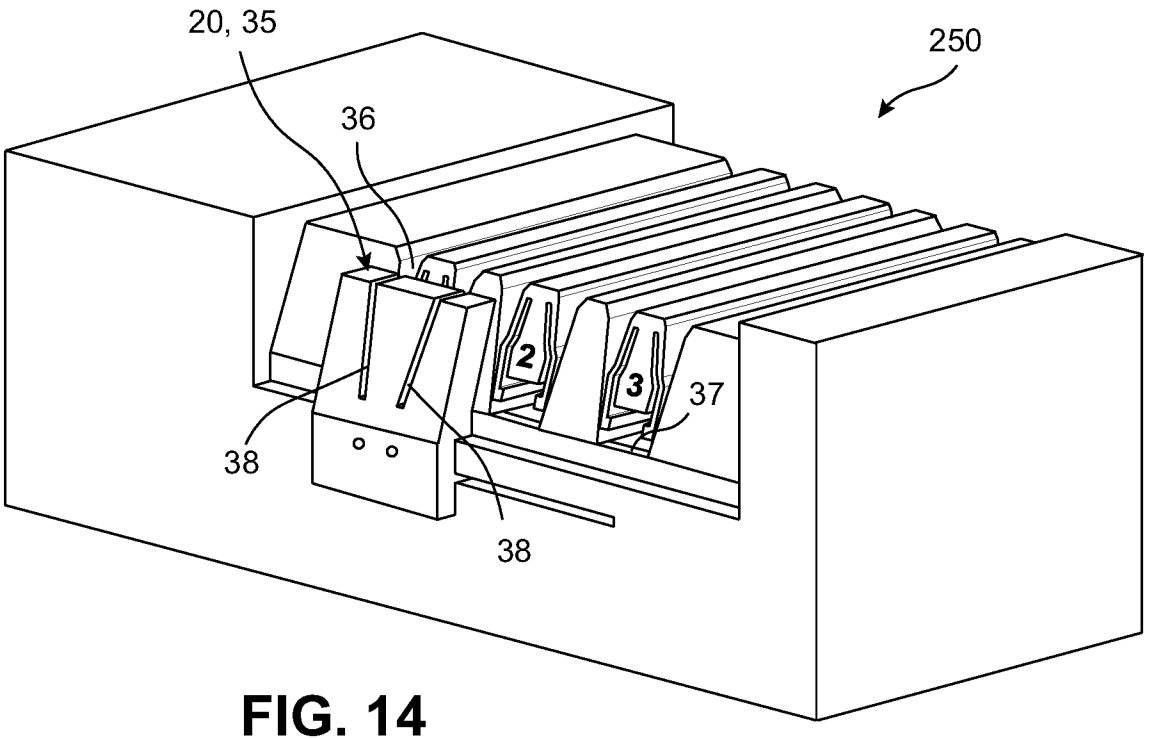
FIG. 14 is a perspective view of an electric knife sharpener having the observation device installed into a moveable housing slidable laterally to correspond to multiple different sharpening stages of the electric sharpener.

FIGS. 12-14 illustrate various different electric knife sharpeners 230, 240, 250 wherein the corresponding observation device 20 is integrated into a moveable housing 35. Each of the electric knife sharpeners 230, 240, 250 includes one or more face guide surfaces 36 that are configured to engage one of the faces 3, 4 of the blade 2 when the blade 2 is pulled relative to a corresponding grinding surface. Each of the electric knife sharpeners 230, 240, 250 may further include one or more edge guide surfaces 37 for establishing a lowermost position for the edge 5 of the blade 2 to engage during the pulling of the blade 2 relative to the grinding surface.

Each of the moveable housings 35 defines a slot 38 having substantially the same structure as the slot 24 of the stand-alone version of the observation device 20 as disclosed in FIGS. 4-6, including the use of an inset sensor assembly that provides a desired orientation of the corresponding sensor elements relative to the blade 2 when passing through the slot 38 as well as face and edge guide surfaces for establishing the proper position of the blade 2 during the pull. The slots 38 may differ from the slot 24 in that the slots 38 may be arranged to match the inclination of the face guide surfaces 36 associated with each of the grinding surfaces, thereby resulting in each of the features being similarly inclined. The slots 38 may further differ by including only one of the sensor assemblies 125 in a laterally outermost surface defining each of the slots 38 such that the corresponding sensor assembly 125 observes only the face 3, 4 of the blade 2 opposite the face 3, 4 of the blade 2 recently ground by the corresponding grinding surface. However, sensor assemblies 125 may be included in each side of each of the slots 38, as desired, without departing from the scope of the present invention.

Each of the disclosed moveable housings 35 may be mounted on a rail or include projecting structure received in a corresponding slot for translating each of the moveable housings 35 in a desired direction. FIG. 12 illustrates the electric knife sharpener 230 as having a single one of the moveable housings 35 having two of the slots 38 configured for selective alignment with the face guide surfaces 36 and the edge guide surfaces 37 associated with grinding each side of the blade 2 during a first grinding stage or step. The moveable housing 35 is slidable between an extended position (shown in FIG. 12) wherein the slots 38 are aligned with the guide surfaces 36, 37 and a retracted position wherein the moveable housing 35 is moved away from the guide surfaces 36, 37 and to a position preventing interference between the moveable housing 35 and the knife 1 during a sharpening thereof. FIG. 13 illustrates a moveable housing 35 having six of the slots 38 with each of the slots 38 corresponding to one of the face guide surfaces 36 of the electric knife sharpener 240. The moveable housing 35 is similarly moveable between an extended and aligned position and a retracted and misaligned position. FIG. 14 illustrates a moveable housing 35 having two of the slots 38 that is capable of sliding or otherwise translating laterally to align the slots 38 with the face guide surfaces 36 associated with any of the grinding surfaces of the electric knife sharpener 250. The moveable housing 35 may accordingly be moveable between the different sharpening stages by the operator of the electric knife sharpener 250 to allow for observation of the blade at each possible sharpening stage for each side of the blade 2. The moveable housings 35 accordingly allow for the associated sensor assemblies 125 to be selectively provided immediately adjacent and downstream of the associated grinding surface to allow for an observing of the blade 2 immediately following a grinding of the blade 2, thereby allowing for a single pulling of the knife 1 through any of the electric knife sharpeners 230, 240, 250 to include both the sharpening of the blade 2 and the observation of the blade 2.

Figure 15:
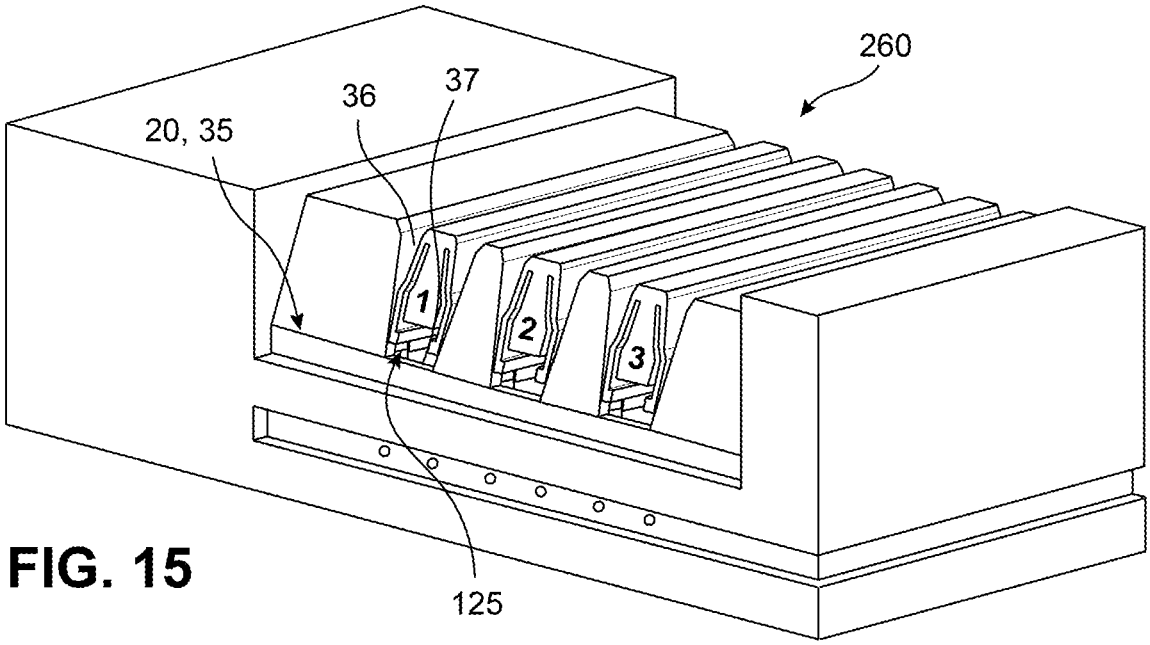
FIG. 15 is a perspective view of an electric knife sharpener having the observation device installed directly into the structure of the electric knife sharpener to perform observations during a pass of the blade through the electric knife sharpener.
Figure 16:
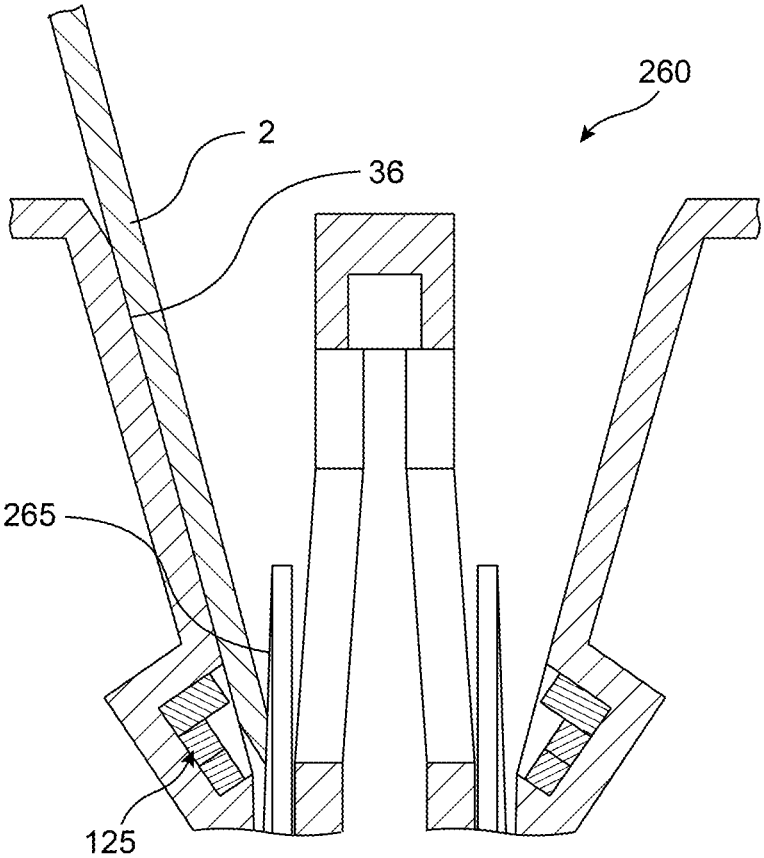
FIG. 16 is an elevational fragmentary cross-sectional view of a portion of the electric knife sharpener of FIG. 15.

FIGS. 15 and 16 illustrate an embodiment wherein the sensor assemblies 125 are directly integrated into an electric knife sharpener 260. The sensor assemblies 125 are once again disposed immediately downstream of a corresponding grinding surface 265 (FIG. 16) to allow for the observation and analysis of the blade 2 to occur immediately after the grinding has occurred. As best shown in FIG. 16, each of the sensor assemblies 125 may be inset into the corresponding face guide surface 36 at a position devoid of the edge guide surface 37 to allow for an orientation of the sensor assembly 125 relative to the edge 5 similar to those disclosed in FIGS. 6-8.

Figure 17:
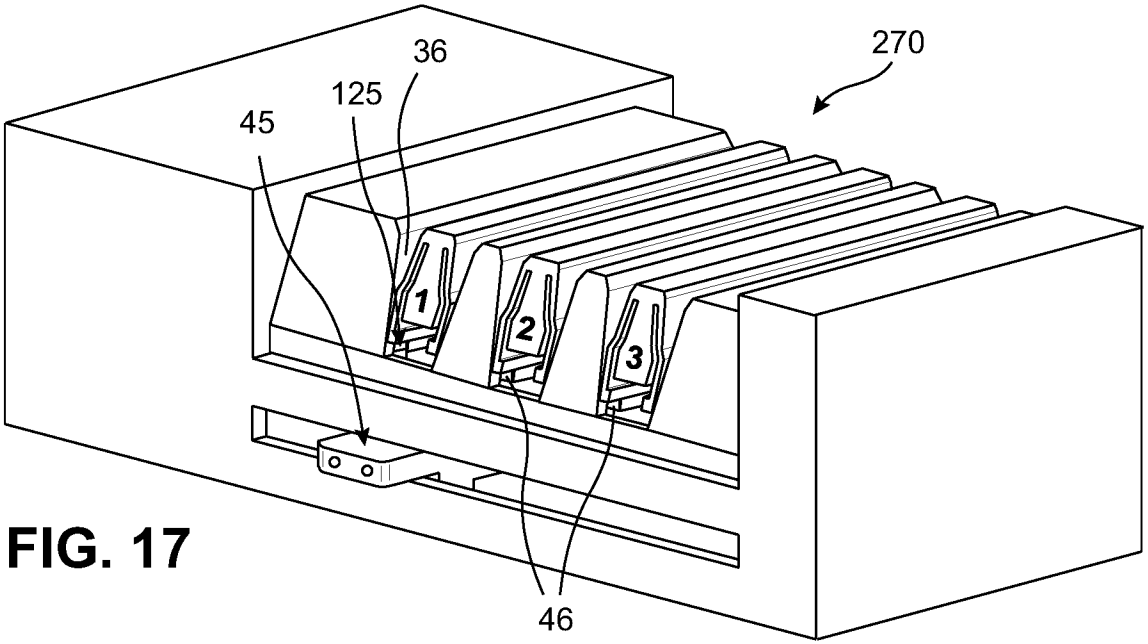
FIG. 17 is a perspective view of an electric knife sharpener having a moveable sensor structure for repositioning the observation device relative to the grinding surfaces of the electric knife sharpener.

FIG. 17 illustrates one final electric knife sharpener 270 having a moveable sensor structure 45. The moveable sensor structure 45 moves one or more of the sensor assemblies 125 coupled to the moveable sensor structure 45 in the lateral direction to align the sensor assemblies 125 adjacent different ones of the grinding surfaces and face guide surfaces 36 to avoid the need for one of the sensor assemblies 125 to be assigned to each grinding surface of the electric knife sharpener 270. The use of the moveable sensor structure 45 may require corresponding slots 46 to be formed in the housing 272 of the electric knife sharpener 270 to allow for the lateral motion of the sensor assemblies 125. The sensor assemblies 125 may accordingly be moved laterally as the blade 2 progresses to each new step of the associated sharpening process.

Although not pictured herein, one or more of the sensor assemblies 125 may be positioned and oriented to view the edge 5 of the blade 2 from a perspective below the edge 5, thereby presenting an edge view of the blade 2. Such a configuration may require the corresponding sensor assembly 125 to be inset relative to a corresponding edge guide surface 34 of the corresponding observation device 20 or electric knife sharpener.

If presented in a significantly simplified form, the observation device 20 may be further provided or packaged with a mechanical goniometer allowing for a mechanical measuring of the angle formed between the faces 3, 4 and facets 9 of the blade 2. The observation device 20 may further include a stand-alone magnification device (not shown) for visually observing the blade 2 independently of the disclosed sensor elements 120.

From the foregoing description, one ordinarily skilled in the art can easily ascertain the essential characteristics of this invention and, without departing from the spirit and scope thereof, can make various changes and modifications to the invention to adapt it to various usages and conditions.

What is claimed is:

1. An observation device for observing a blade of a knife, the observation device comprising:

a sensor element configured to observe the blade and collect data regarding the blade when the blade is moved relative to the sensor element;

a display element configured to communicate a condition of the blade to an operator of the observation device, the condition of the blade based on the data collected by the sensor element when the blade is moved relative to the sensor element; and at least one guide surface for establishing a position of the blade relative to the sensor element when the blade is moved relative to the sensor element, wherein the sensor element is inset into one of the at least one guide surfaces.

2. The observation device of claim 1, wherein the at least one guide surface includes a first guide surface for engaging a face of the blade and a second guide surface for engaging an edge of the blade.

3. The observation device of claim 1, wherein the condition of the blade is one of a knife blade root mean squared value or a roughness average value of the blade.

4. The observation device of claim 1, wherein the condition of the blade includes a determination of the presence of a burr to one side of an edge of the blade.

5. The observation device of claim 1, wherein the sensor element forms a portion of a sensor assembly including a plurality of the sensor elements, wherein at least one of the sensor elements forming the sensor assembly views the blade from a different perspective from the remaining sensor elements.

6. The observation device of claim 1, wherein the sensor element is one of a mouse sensor, a camera, or a diffusion sensor.

7. A knife sharpener comprising:

a grinding surface for grinding a blade of the knife when the blade is moved relative to the grinding surface;

an observation device including a sensor element and a display element, the sensor element configured to observe the blade and collect data regarding the blade when the blade is moved relative to the sensor element, and the display element configured to communicate a condition of the blade to an operator of the observation device, the condition of the blade based on the data collected by the sensor element when the blade is moved relative to the sensor element; and a first guide surface disposed adjacent the grinding surface for guiding the blade of the knife when the blade is moved relative to the grinding surface, wherein the sensor element is inset into the first guide surface.

8. The knife sharpener of claim 7, wherein the grinding surface and the observation device are supported by a single housing structure.

9. The knife sharpener of claim 7, wherein the grinding surface is supported by a first housing structure and the observation device is supported by a second housing structure, the second housing structure provided as an accessory configured for removable coupling to the first housing structure.

10. The knife sharpener of claim 7, wherein the sensor element is positioned to be passed by the blade after the blade has passed by the grinding surface.

11. The knife sharpener of claim 7, wherein the sensor element is inset into a second guide surface, the second guide surface movable relative to the first guide surface between an aligned position wherein the first guide surface and the second guide surface are aligned and a misaligned position wherein the first guide surface and the second guide surface are misaligned.

12. The knife sharpener of claim 7, wherein the knife sharpener includes a plurality of the grinding surfaces spaced apart from each other and the sensor element is movable between each of the spaced apart grinding surfaces.

13. A method of determining a condition of a blade of a knife prior to or following a sharpening process, the method comprising the steps of:

providing an observation device including a sensor element and a display element, wherein the sensor element is inset into at least one guide surface for guiding the blade of the knife when the blade is moved;

moving the blade relative to the sensor element to observe the blade and collect data regarding the blade; and communicating a condition of the blade to an operator of the observation device following the moving of the blade relative to the sensor element.

14. The method of claim 13, wherein the moving of the blade relative to the sensor element occurs while the blade is also moving relative a grinding surface engaging the blade.

15. The method of claim 14, wherein the observing of the blade occurs with respect to a portion of the blade that has engaged the grinding surface during the moving of the blade relative to the sensor element.

16. The method of claim 13, further comprising a step of aligning the sensor element with the grinding surface.

17. The method of claim 16, wherein the sensor element is mounted to a structure movable relative to the grinding surface.

* * * * *